US010167063B2

(12) United States Patent
Lin et al.

(10) Patent No.: US 10,167,063 B2
(45) Date of Patent: Jan. 1, 2019

(54) UNDERWATER OPERATION PLATFORM AND METHOD FOR USING THE SAME

(71) Applicant: DALIAN UNIVERSITY OF TECHNOLOGY, Dalian (CN)

(72) Inventors: Yan Lin, Dalian (CN); Xiaoning Jiang, Dalian (CN); Tieli Li, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 0 days.

(21) Appl. No.: 15/951,134

(22) Filed: Apr. 11, 2018

(65) Prior Publication Data

US 2018/0229819 A1 Aug. 16, 2018

Related U.S. Application Data

(63) Continuation-in-part of application No. PCT/CN2017/078080, filed on Mar. 24, 2017.

(30) Foreign Application Priority Data

Apr. 3, 2016 (CN) ..... 2016 1 0200499

(51) Int. Cl.

| | |
|---|---|
| ***B63B 35/44*** | (2006.01) |
| ***E02B 17/02*** | (2006.01) |
| ***B66F 11/00*** | (2006.01) |
| *B63C 11/52* | (2006.01) |

(52) U.S. Cl.

CPC ..... *B63B 35/44* (2013.01); *B66F 11/00* (2013.01); *E02B 17/02* (2013.01); *B63C 11/52* (2013.01)

(58) Field of Classification Search

CPC ..... B63B 35/44; B63B 35/4413; B63B 2035/4426

See application file for complete search history.

(56) References Cited

U.S. PATENT DOCUMENTS

| | | | | |
|---|---|---|---|---|
| 8,739,717 | B2 * | 6/2014 | Ellnor | B63B 25/00 114/61.22 |
| 9,051,783 | B2 * | 6/2015 | Croatto | E21B 19/006 |
| 2013/0322969 | A1 * | 12/2013 | Gleadowe | B63B 1/10 405/196 |
| 2014/0238289 | A1 * | 8/2014 | Sun | B63B 35/4413 114/265 |
| 2016/0177631 | A1 * | 6/2016 | Chiu | E21B 15/02 166/352 |

* cited by examiner

*Primary Examiner* — Andrew Polay
(74) *Attorney, Agent, or Firm* — Matthias Scholl P.C.; Matthias Scholl

(57) ABSTRACT

An underwater operation platform, including: a main body; two ducted propellers disposed at the tail end of the main body; a living building; pile legs; a tower crane; a submergence module; lifting devices; and a gantry crane. The main body includes a deck and a moonpool. The submergence module includes a support plate, a plurality of truss members, and a base plate. The living building disposed on the front end of the deck. The pile legs are disposed at the four corners of the main body, respectively. The deck includes two parallel pathways which are located at two sides of the moonpool, respectively, for supporting the gantry crane. The lifting devices are disposed on the deck and are close to four corners of the moonpool. The support plate and the base plate are integrated with the plurality of truss members.

4 Claims, 11 Drawing Sheets

UNDERWATER OPERATION PLATFORM AND METHOD FOR USING THE SAME

CROSS-REFERENCE TO RELATED APPLICATIONS

This application is a continuation-in-part of International Patent Application No. PCT/CN2017/078080 with an international filing date of Mar. 24, 2017, designating the United States, now pending, and further claims foreign priority benefits to Chinese Patent Application No. 201610200499.X filed Apr. 3, 2016. The contents of all of the aforementioned applications, including any intervening amendments thereto, are incorporated herein by reference.

BACKGROUND OF THE INVENTION

Field of the Invention

The invention relates to the field of ocean engineering, and more particularly to an underwater operation platform and method for using the same.

Description of the Related Art

Typically, underwater operations are implemented by using small, single-purpose devices. The devices are costly, inefficient, can carry low loads only, are difficult to coordinate, and exhibit poor stability, which makes them unsuitable for use under severe swell conditions.

SUMMARY OF THE INVENTION

In view of the above-described problems, it is one objective of the invention to provide an underwater operation platform that is multifunctional, safe, stable, easy to operate and maintain. The platform can provide various services such as underwater resources exploration, auxiliary maintenance of oil and gas resources, emergency rescue and salvage, underwater engineering support precisely, efficiently, and reliably under variable load conditions.

It is another objective of the invention to provide a method for using the same.

To achieve the above objective, in accordance with one embodiment of the invention, there is provided an underwater operation platform, comprising:

- a main body, the main body comprising a deck and a moonpool;
- two ducted propellers disposed at a tail end of the main body;
- a living building disposed on a front end of the deck;
- pile legs;
- a tower crane;
- a submergence module, the submergence module comprising a support plate, a plurality of truss members, and a base plate;
- lifting devices, each lifting device comprising a steel cable; and
- a gantry crane.

Specifically, the main body is rectangular and comprises four corners; the moonpool is rectangular and runs through a molded depth of the main body; the pile legs are disposed at the four corners of the main body, respectively; the tower crane sleeves one of the pile legs disposed at the tail end of the main body; the deck comprises two parallel pathways which are located at two sides of the moonpool, respectively, for supporting the gantry crane; the lifting devices are disposed on the deck and are close to four corners of the moonpool; a surface area of the submergence module is less than that of the moonpool; each lifting device is connected to one corner of the submergence module via the steel cable; the support plate and the base plate are integrated with the plurality of truss members; the main body further comprises inner side walls facing the moonpool, and the inner side walls are provided with watertight doors communicating with operation cabins of the main body.

In a class of this embodiment, the tower crane comprises a suspension arm, a lifting hook, a control room, and a balance weight.

In a class of this embodiment, the lifting devices each further comprise a winch, a bracket, and a pulley disposed on the bracket; the steel cable winds the pulley, one end of the steel cable is connected to a hub of the winch, and the other end of the steel cable is connected to a lifting lug of the submergence module.

In another aspect, the disclosure also provides a method for using the underwater operation platform, the method comprising:

1) withdrawing the pile legs and the leg sleeves in the main body; withdrawing the submergence module in the moonpool until the base plate of the submergence module aligns to a bottom of the main body; withdrawing the tower crane and the gantry crane in the main deck; starting a dynamic positioning system of the underwater operation platform to control the ducted propellers to operate; and navigating the underwater operation platform to an oceanic operation area;
2) charging ballast tanks of the main body with water; descending the pile legs 6 and the leg sleeves until the leg sleeves land on the seabed; operating the tower crane and the gantry crane and laying out measuring equipment on the support plate of the submergence module; and lifting the main body out of water surface;
3) submerging the submergence module in the water using the lifting devices for underwater operations;
4) hoisting and withdrawing the submergence module in the moonpool using the lifting devices;
5) discharging water in the ballast tanks, withdrawing the pile legs and the leg sleeves in the main body; and
6) navigating the underwater operation platform to a next operation area.

Advantages of the underwater operation platform and method for using the same according to embodiments of the invention are summarized as follows. The underwater operation platform comprises: a main body comprising a deck and a moonpool; two ducted propellers disposed at a tail end of the main body; a living building disposed on the front end of the deck; pile legs; a tower crane; a submergence module comprising a support plate, a plurality of truss members, and a base plate; lifting devices comprising a steel cable; and a gantry crane. The main body is rectangular and comprises four corners; the moonpool is rectangular and runs through a molded depth of the main body; the pile legs are disposed at the four corners of the main body, respectively; the tower crane sleeves one of the pile legs disposed at the tail end of the main body; the deck comprises two parallel pathways which are located at two sides of the moonpool, respectively, for supporting the gantry crane; the lifting devices are disposed on the deck and are close to four corners of the moonpool; a surface area of the submergence module is less than that of the moonpool; each lifting device is connected to one corner of the submergence module via the steel cable; the support plate and the base plate are integrated with the plurality of truss members; the main body further comprises inner side walls facing the moonpool, and the inner side walls are provided with watertight doors communicating with operation cabins of the main body. The underwater operation platform is multifunctional, safe, stable, easy to operate and maintain. The platform can provide various services such as underwater resources exploration, auxiliary maintenance of oil and gas resources, emergency rescue and salvage, underwater engineering support precisely, efficiently, and reliably under variable load conditions.

BRIEF DESCRIPTION OF THE DRAWINGS S

Figure 1:
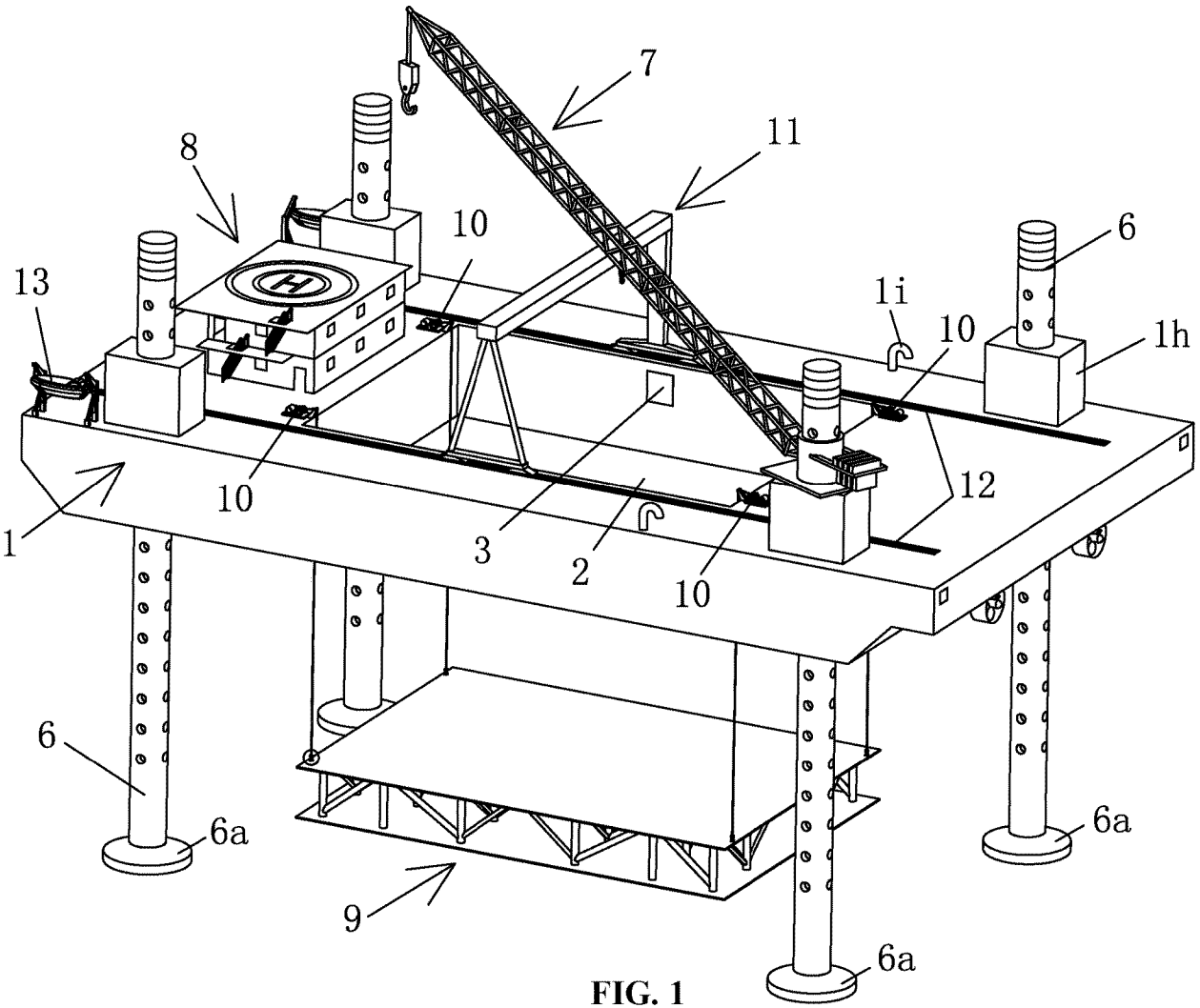
FIG. 1 is a stereogram of an underwater operation platform according to one embodiment of the disclosure.

In the drawings, the following reference numbers are used: 1. Main body; 1*a*. Operation cabin; 1*b*. Engine room; 1*c*. Ballast tank; 1*d*. Fresh water tank, 1*e*. Fuel tank, 1*f*. Pump room; 1*g*. Main deck; 1*h*. Pile fixing area; 1*i*. Air inlet pipe; 1*j*. Air outlet; 2. Moonpool; 3. Watertight door; 4. Ducted propeller; 5. Diversion channel; 6. Pile leg; 6*a*. Leg sleeve; 6*b*. Pin hole; 7. Tower crane; 7*a*; Suspension arm; 7*b*. Lifting hook; 7*c*. Control room; 7*d*. Balance weight; 8. Living building; 8*a*. Helideck; 8*b*. Ladder; 8*c*. Window; 9. Submergence module; 9*a*. Support plate; 9*b*. Truss member; 9*c*. Base plate; 9*d*. Lifting lug; 10. Lifting device; 10*a*. Winch; 10*b*. Bracket; 10*c*. Pulley; 10*d*. Steel cable; 11. Gantry crane; 11*a*. Hanger; 11*b*. Wheel; 12. Pathway; 13. Lifeboat.

DETAILED DESCRIPTION OF THE EMBODIMENTS

For further illustrating the invention, experiments detailing an underwater operation platform and method for using the same are described below. It should be noted that the following examples are intended to describe and not to limit the invention.

Figure 2:
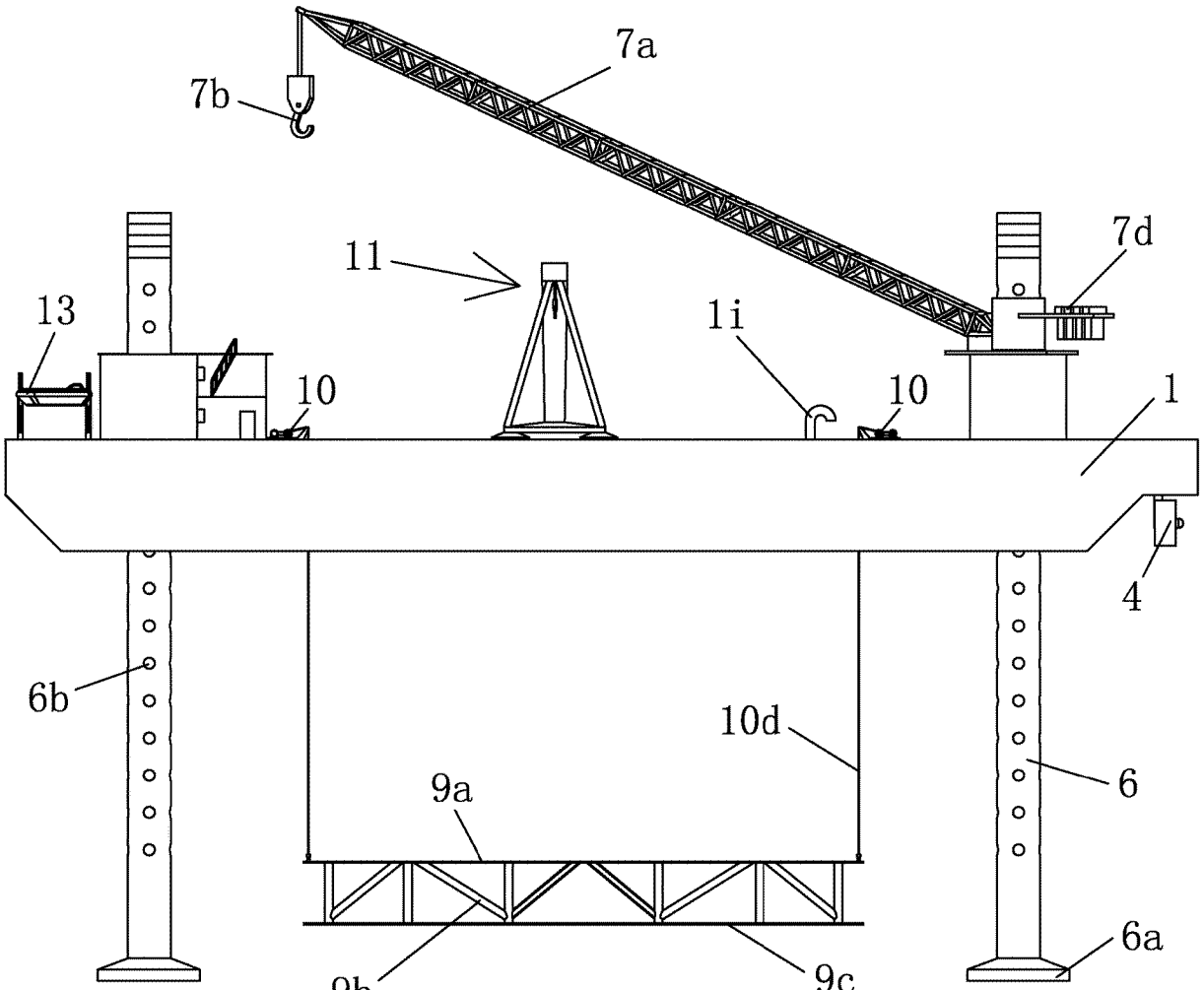
FIG. 2 is a side view of an underwater operation platform according to one embodiment of the disclosure.
Figure 3:
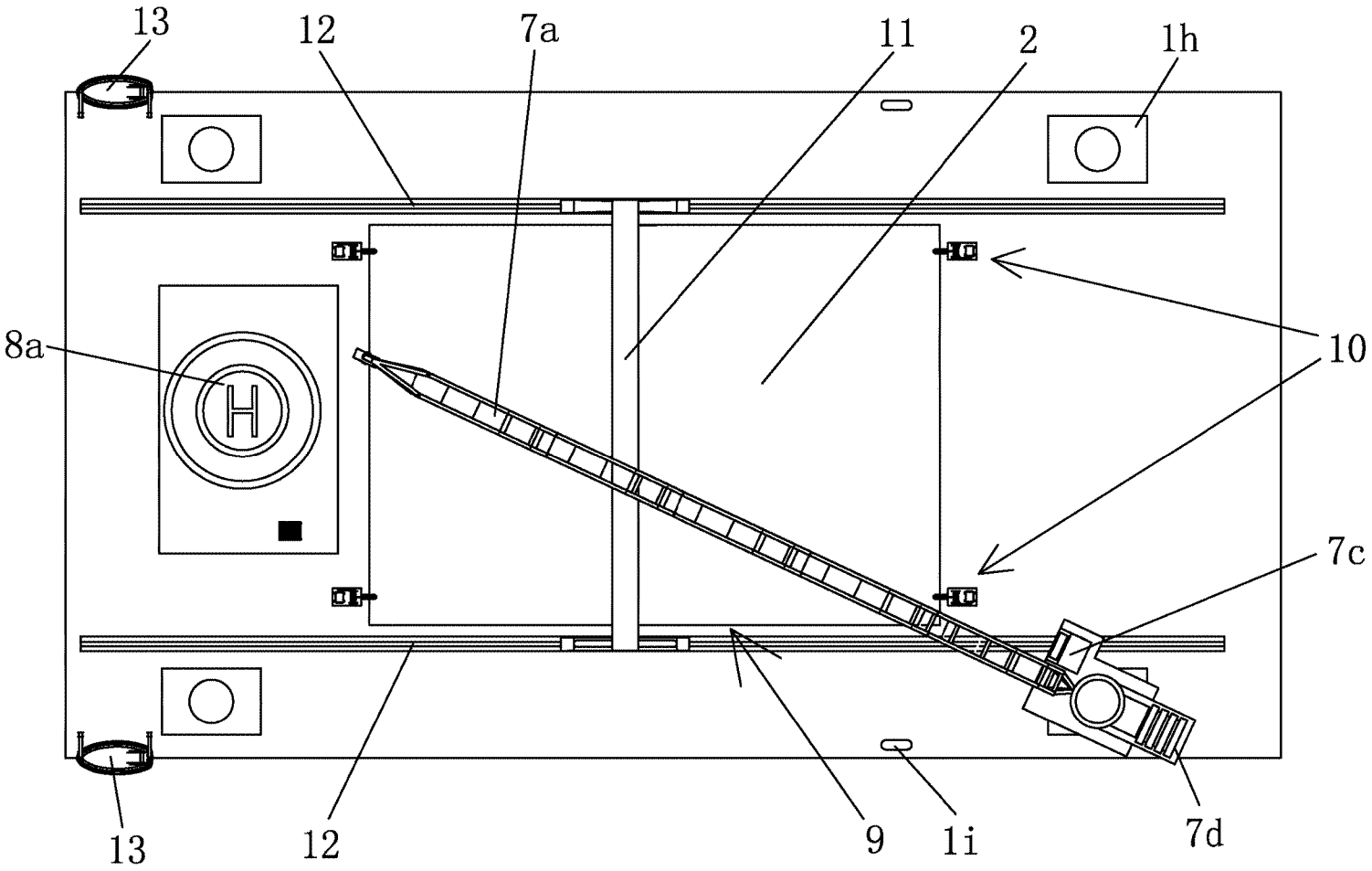
FIG. 3 is a top view of an underwater operation platform according to one embodiment of the disclosure
Figure 4:
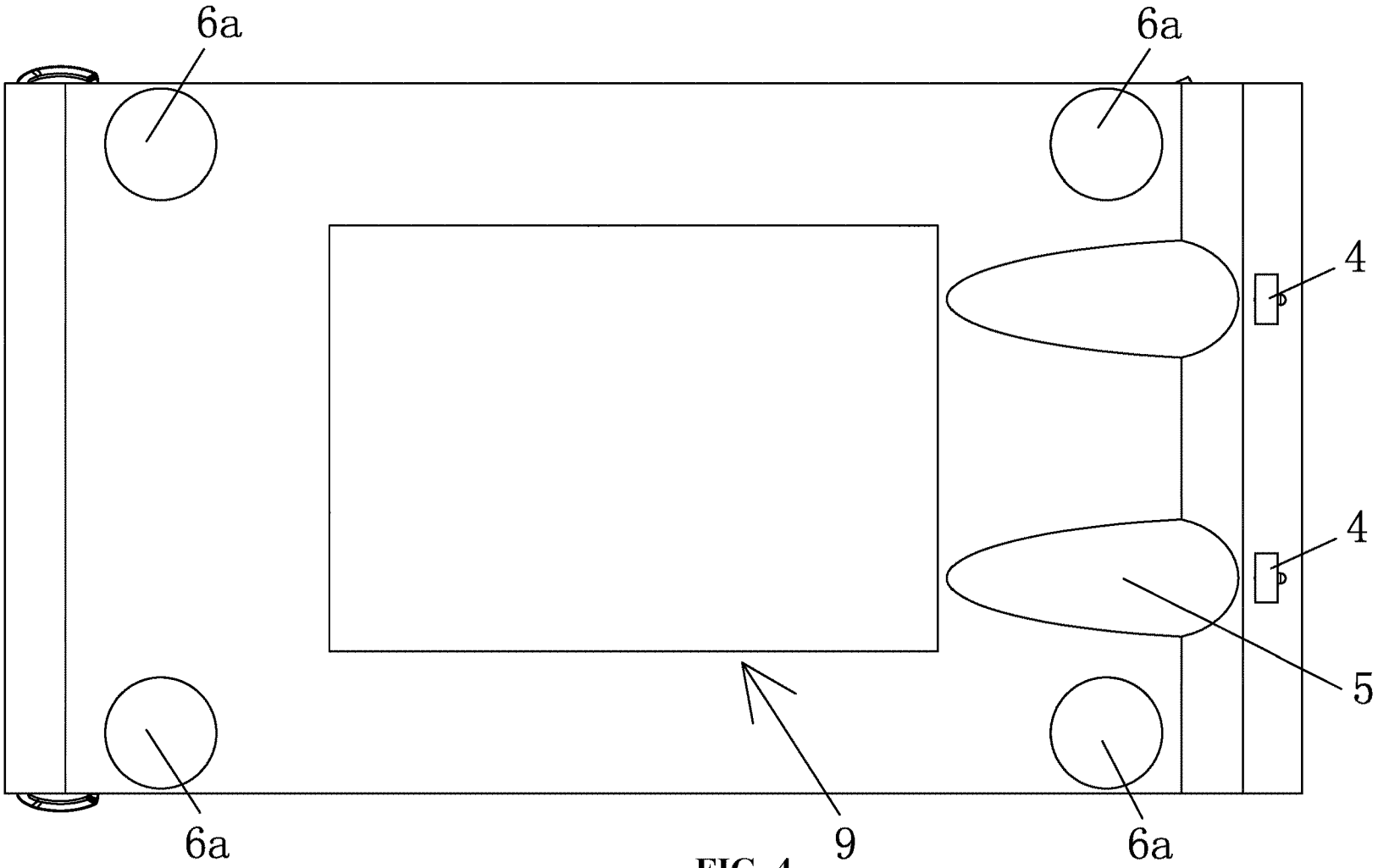
FIG. 4 is a bottom view of an underwater operation platform according to one embodiment of the disclosure.
Figure 5:
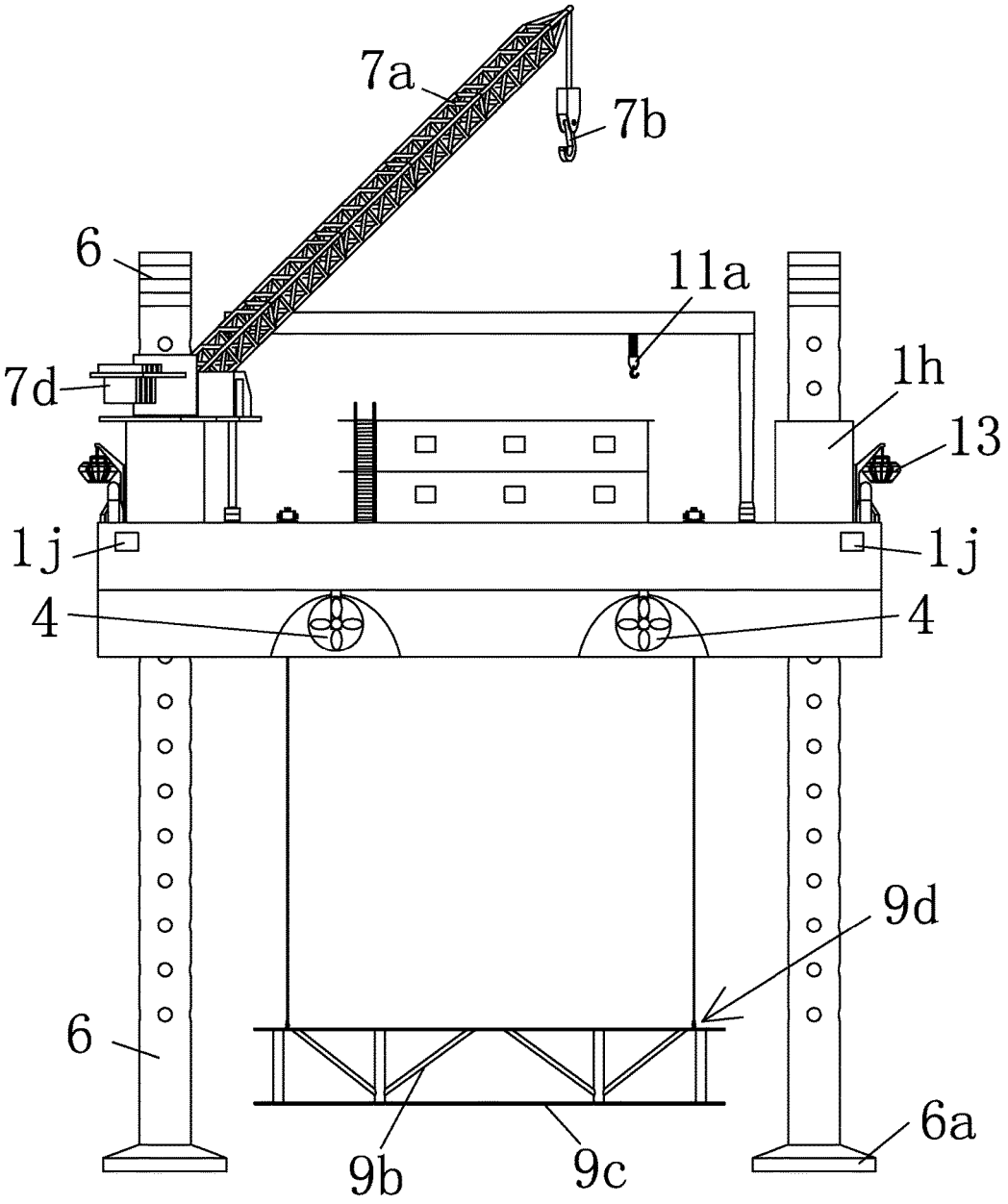
FIG. 5 is a schematic diagram of an underwater operation platform in a tail direction according to one embodiment of the disclosure.
Figure 6:
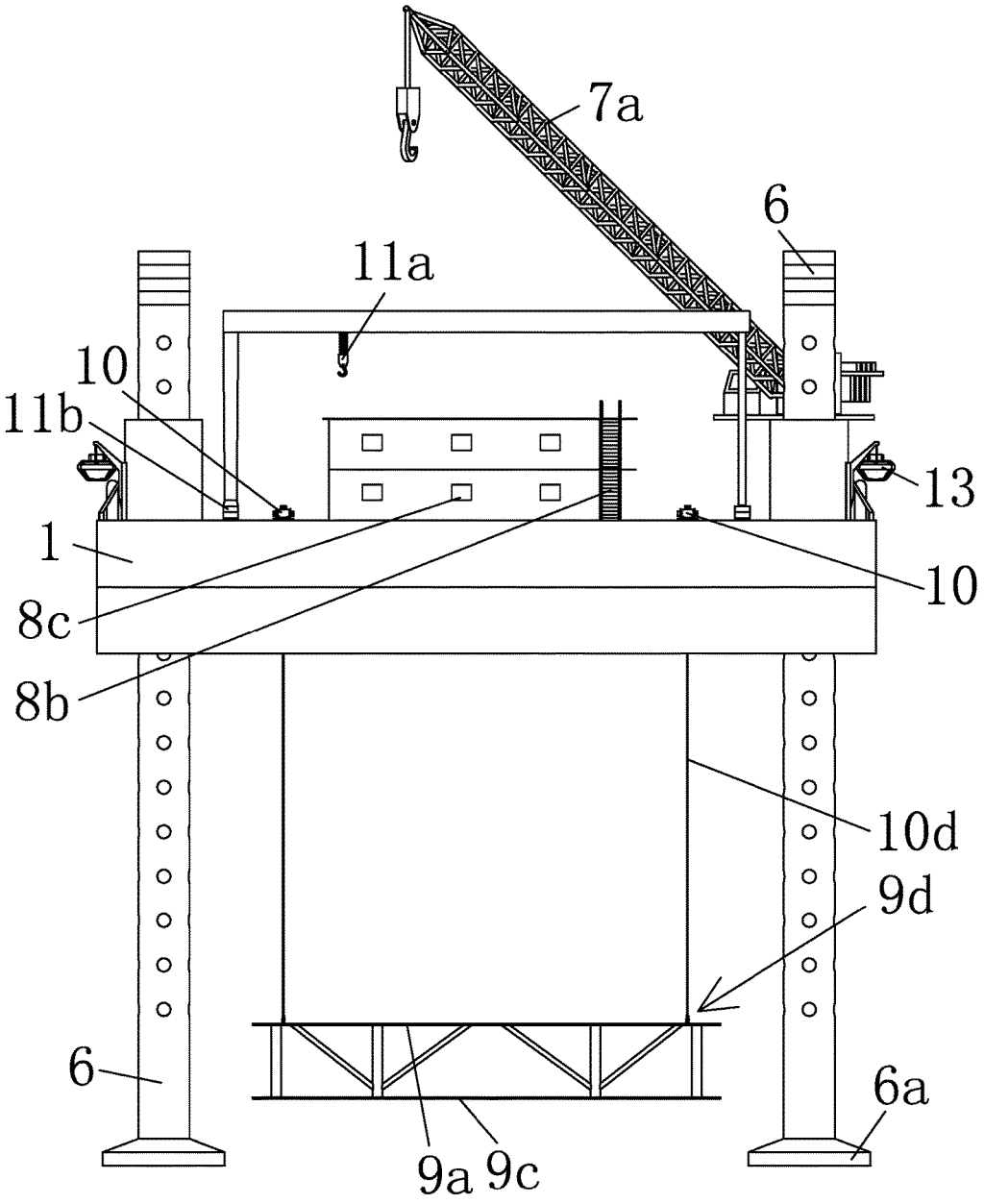
FIG. 6 is a schematic diagram of an underwater operation platform in a head direction according to one embodiment of the disclosure.
Figure 7:
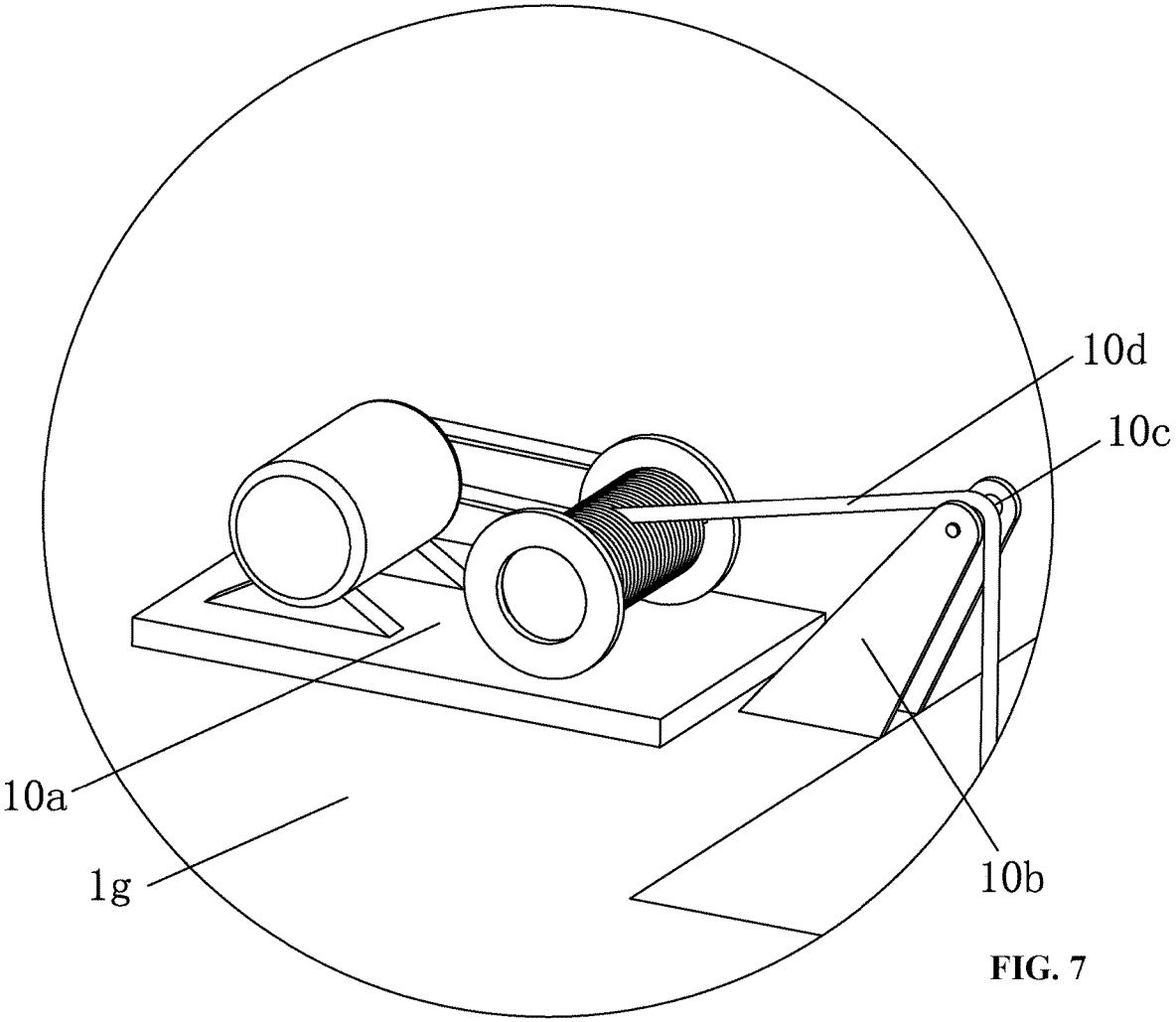
FIG. 7 is a local enlarged view of a lifting device of an underwater operation platform according to one embodiment of the disclosure.

FIG. 1 is a stereogram of an underwater operation platform of the disclosure; FIG. 2 is a side view of the underwater operation platform; FIG. 3 is a top view of the underwater operation platform; FIG. 4 is a bottom view of the underwater operation platform; FIG. 5 is a schematic diagram of the underwater operation platform in a tail direction; FIG. 6 is a schematic diagram of the underwater operation platform in a head direction. The underwater operation platform comprises a main body 1, a submergence module 9, and pile legs 6. The front and tail ends of the main body 1 are both wedge-shaped, so as to reduce the ship resistance. The main body 1 comprises a deck and a moonpool 2. The deck comprises pile fixing areas 1*h*. The main body 1 is connected to the cylindrical pile legs 6 via the pile fixing areas 1*h*. The pile legs 6 adapt to support the main body 1. The main body 1 is capable of moving up and down along the pile legs 6. The pile legs 6 are provided with pin holes 6*b* which adapt to lock the main body 1 on the pile legs 6. Each pile leg 6 is equipped with a leg sleeve 6*a*, which is beneficial to increasing the force area of the leg sleeve 6*a* against the seabed, and increasing the supporting force of the pile leg 6 for the main body 1. The moonpool 2 is rectangular and runs through a molded depth of the main body. The submergence module 9 is disposed in the moonpool 2. The submergence module 9 comprises four corners which are connected to the lifting devices 10 disposed on the main deck 1*g* of the main body 1 via steel cables 10*d* (as shown in FIG. 7). Through the lifting and releasing of the lifting devices, the submergence module 9 passes through the moonpool 2 and submerges into the water or on seabed for operation.

Figure 8:
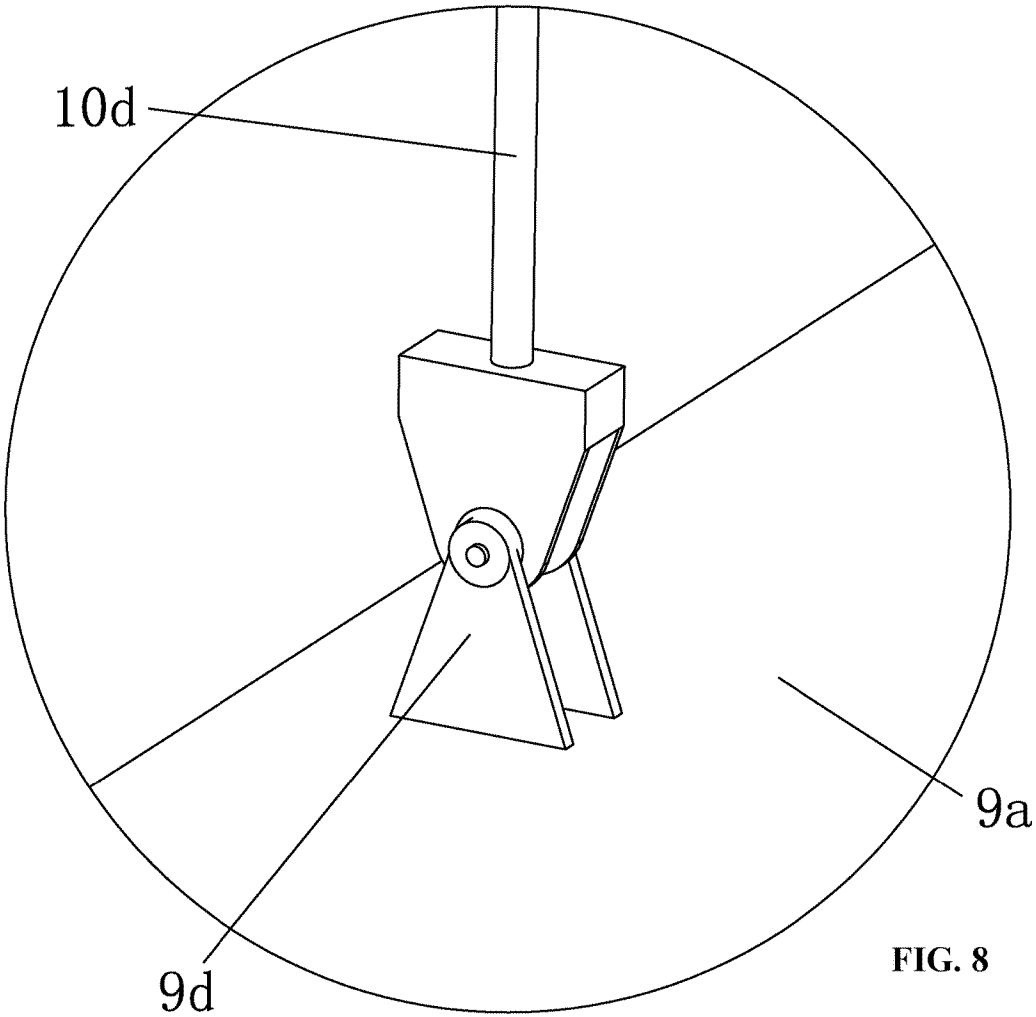
FIG. 8 is a local enlarged view of a lifting lug of an underwater operation platform according to one embodiment of the disclosure.

The lifting devices 10 each comprise a winch 10*a*, a bracket 10*b*, a pulley 10*c*, and a steel cable 10*d*. The pulley 10*c* is disposed on the bracket 10*b*. The steel cable 10*a* winds the pulley 10*c*, one end of the steel cable 10*a* is connected to the hub of the winch 10*a*, and the other end thereof is connected to the lifting lug 9*d* of the submergence module 9 (as shown in FIG. 8). The submergence module 9 comprises a support plate 9*a*, a base plate 9*c*, and a plurality of truss members 9*b* which connect the support plate 9*a* and the base plate 9*c*. The lifting lug 9*d* is disposed on each of four corners of the support plate 9*a* and cooperates with vertical bars of the truss members 9*b* to form a continuous force transmission structure. The submergence module 9 is light, features little flow resistance, thus ensuring the stable operation of the underwater operation platform. The entire structure of the operation platform comprising the submergence module 9, the lifting lug 9*d* and the lifting devices 10 is easy to maintain.

Figure 9:
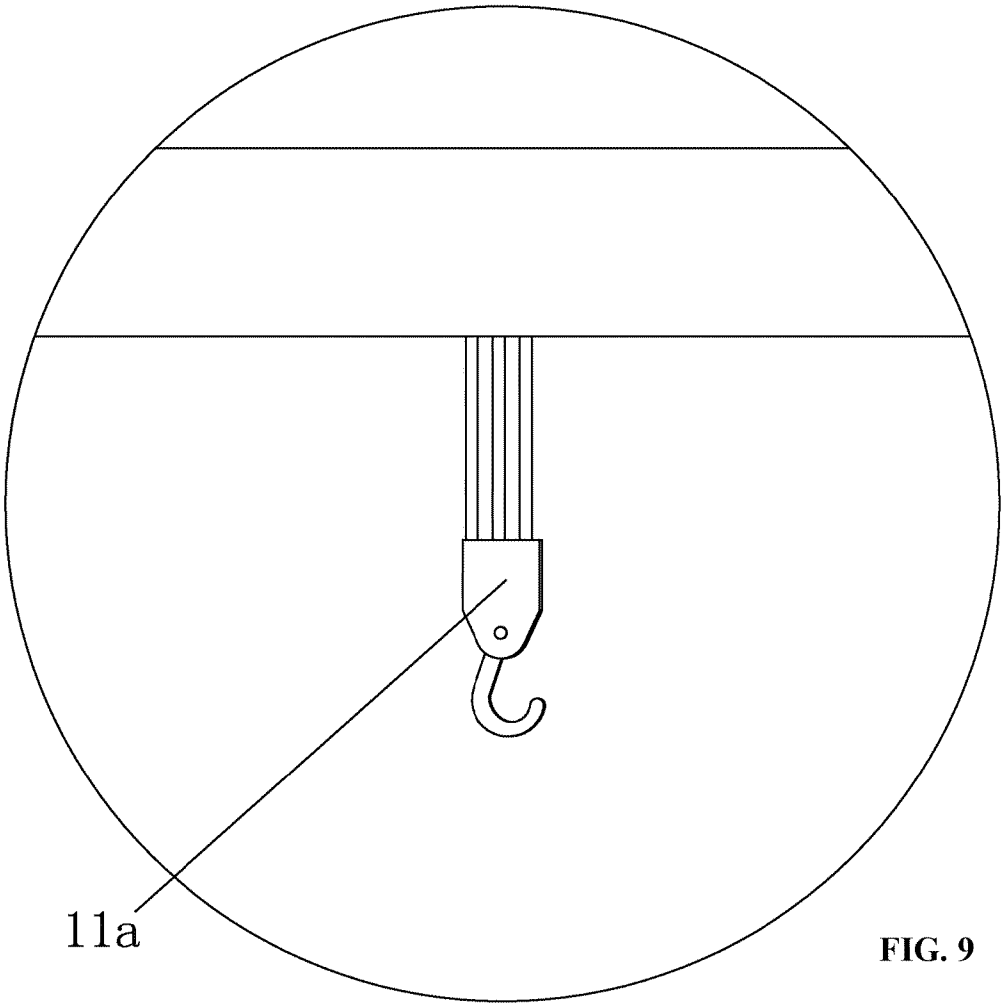
FIG. 9 is a local enlarged view of a lifting hook of an underwater operation platform according to one embodiment of the disclosure.

A tower crane 7 is disposed above the pile fixing area 1*h* of the main deck. The tower crane 7 and the pile fixing area 1*h* form a continuous structure. The tower crane 7 is disposed out of the pile legs 6, and there is no motion interference between the two components. The tower crane 7 comprises a suspension arm 7*a*, a lifting hook 7*b*, a control room 7*c*, and a balance weight 7*d*. The length of the suspension arm 7*a* meets the hoisting requirements in the area of the main deck 1*g*. In addition to lifting the main body 1 and the submergence module 9, the tower crane 7 also adapts to lift the auxiliary vessels. The main deck 1*g* comprises two parallel pathways 12 which are located at two sides of the moonpool 2, respectively, for supporting the gantry crane 11. The pathways 12 are disposed on the main body 1 lengthways. The wheels 11*b* of the gantry crane 11 slide on the pathways 12. The gantry crane 11 comprises a beam and a hanger 11*a* fixed on the beam (as shown in FIG. 9). The gantry crane 11 is mainly used for hoisting the support plate 9*a* in the moonpool 2, and also used for hoisting the main deck 1*g* and the living building 8.

The living building 8 is in the shape of a tank with an opening and is located in the center of the head part of the main deck 1*g*. The top of the living building 8 is a helideck 8*a*. Widows 8*b* are disposed on the side walls of the living building 8, and ladders are disposed to connect the top and the bottom of the living building, and also operate as a fire and escape passage, so that the personnel can quickly reach the lifeboats 13 placed at two sides of the head part of the main body 1. Streamlined diversion channels 5 are disposed at the tail end of the main body 1 (as shown in FIG. 4), so that the water flows smoothly to the ducted propeller 4, thus improving the propulsion efficiency of the ducted propeller 4.

Figure 10:
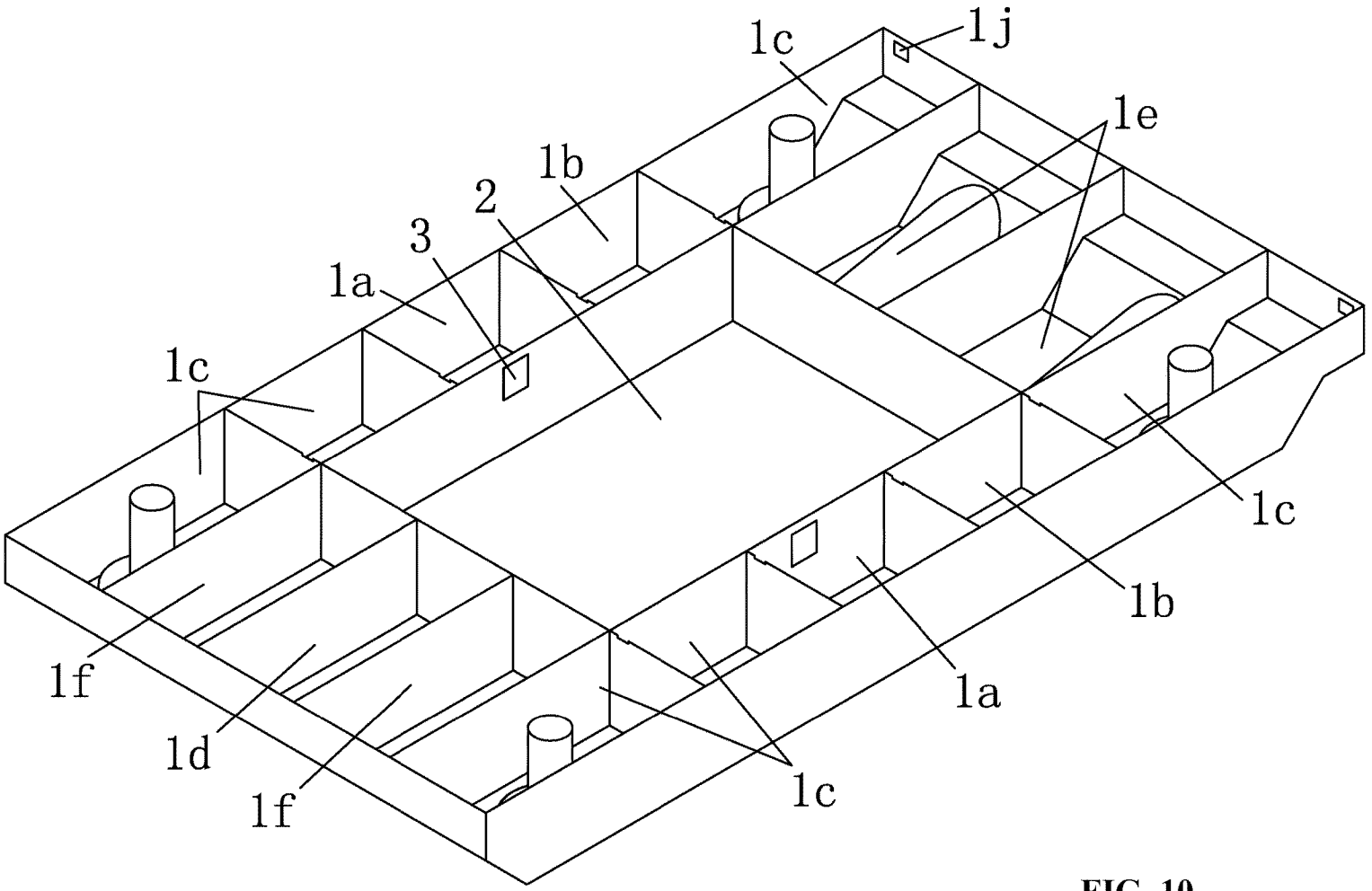
FIG. 10 is a distribution diagram of cabins of an underwater operation platform according to one embodiment of the disclosure.

FIG. 10 is a distribution diagram of cabins of the underwater operation platform. The cabins are the operation cabins 1*a*, engine rooms 1*b*, ballast tanks 1*c*, fresh water tanks 1*d*, fuel tanks 1*e*, and pump rooms 1*f*. The main body 1 further comprises inner side walls facing the moonpool 2, and the inner side walls are provided with watertight doors 3 communicating with operation cabins 1*a* of the main body. When the submergence module 9 is withdrawn in the moonpool 2, the watertight doors 3 open, which facilitates the staff to land down on the support plate 9*a* to work. The ballast tanks 1*c* are close to the pile legs 6, which improves the press capacity of the pile legs 6. The fresh water tanks are disposed below the living building 8, facilitating the layout of the water facilities. The main deck 1*g* is equipped with gooseneck air inlet pipes 1*i* for supplying air for the main engine in the engine room 1*b*. The air outlet 1*j* is disposed at the tail sealing board of the main body and connected to the engine rooms 1*b* via pipes.

Figure 11:
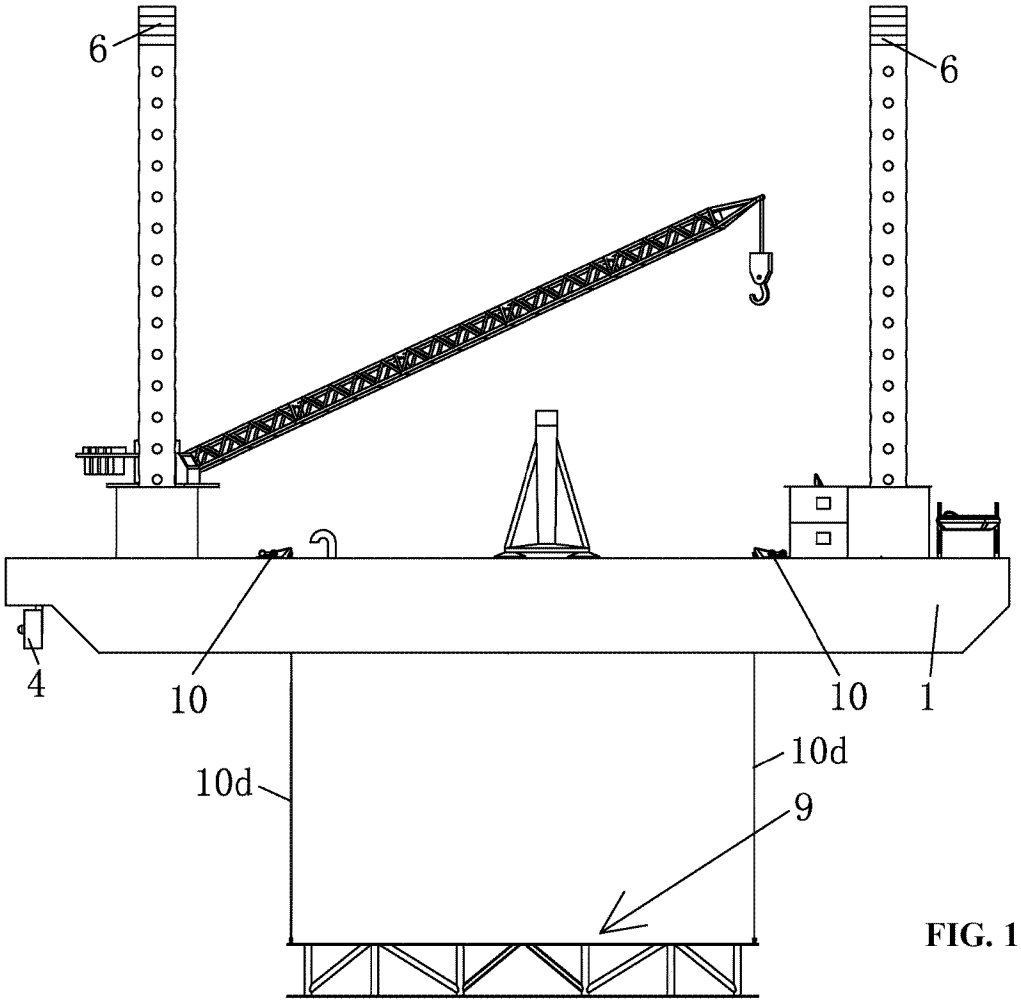
FIG. 11 is a side view of an underwater operation platform in a floating operation state according to one embodiment of the disclosure.

FIG. 11 is a side view of the underwater operation platform in a floating operation state. In case of deep-sea operation, limited by the length of the pile legs 6, the leg sleeves 6*a* fail to contact the seabed, the pile legs 6 and the leg sleeves 6*a* are in the self-propulsion state, and the main body 1 floats in the water. The rotation direction of the ducted propellers 4 are controlled by the dynamic positioning system. The lifting devices 10 control the submergence module 9 to submerge in the water or land on the seabed.

The disclosure also provides a method using the underwater operation platform, which comprises:

1). withdrawing the pile legs 6 and the leg sleeves 6*a* in the main body 1; withdrawing the submergence module 9 in the moonpool 2 until the base plate of the submergence module 9 aligns to a bottom of the main body; withdrawing the tower crane 7 and the gantry crane 11 in the main deck; starting a dynamic positioning system of the underwater operation platform to control the ducted propellers 4 to operate; and navigating the underwater operation platform to an oceanic operation area;

2). charging ballast tanks 1*c* of the main body with water; descending the pile legs 6 and the leg sleeves 6*a* until the leg sleeves 6*a* land on the seabed; operating the tower crane 7 and the gantry crane 11 and laying out measuring equipment on the support plate 9*a* of the submergence module; and lifting the main body 1 out of water surface;

3). submerging the submergence module 9 in the water using the lifting devices 10 for underwater operations;

4). hoisting and withdrawing the submergence module 9 in the moonpool 2 using the lifting devices 10;

5). discharging water in the ballast tanks 1*c*, withdrawing the pile legs 6 and the leg sleeves 6*a* in the main body 1; and 6). navigating the underwater operation platform to a next operation area.

When the underwater operation platform operates in deep sea, there is no need to descend and withdraw the pile legs 6 and the leg sleeves 6*a*.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An underwater operation platform, comprising:

a main body, the main body comprising a deck and a moonpool;

two ducted propellers disposed at a tail end of the main body;

a living building disposed on a front end of the deck;

pile legs;

a tower crane;

a submergence module, the submergence module comprising a support plate, a plurality of truss members, and a base plate;

lifting devices, each lifting device comprising a steel cable; and a gantry crane;

wherein the main body is rectangular and comprises four corners;

the moonpool is rectangular and runs through a molded depth of the main body;

the pile legs are disposed at the four corners of the main body, respectively;

the tower crane sleeves one of the pile legs disposed at the tail end of the main body;

the deck comprises two parallel pathways which are located at two sides of the moonpool, respectively, for supporting the gantry crane;

the lifting devices are disposed on the deck and are close to four corners of the moonpool;

a surface area of the submergence module is less than that of the moonpool; each lifting device is connected to one corner of the submergence module via the steel cable;

the support plate and the base plate are integrated with the plurality of truss members;

the main body further comprises inner side walls facing the moonpool, and the inner side walls are provided with watertight doors communicating with operation cabins of the main body.

2. The platform of claim 1, wherein the tower crane comprises a suspension arm, a lifting hook, a control room, and a balance weight.

3. The platform of claim 1, wherein the lifting devices each further comprise a winch, a bracket, and a pulley disposed on the bracket; the steel cable winds the pulley, one end of the steel cable is connected to a hub of the winch, and the other end of the steel cable is connected to a lifting lug of the submergence module.

4. A method for using the underwater operation platform of claim 1, the method comprising:

1) withdrawing the pile legs and the leg sleeves in the main body; withdrawing the submergence module in the moonpool until the base plate of the submergence module aligns to a bottom of the main body; withdrawing the tower crane and the gantry crane in the deck; starting a dynamic positioning system of the underwater operation platform to control the ducted propellers to operate; and navigating the underwater operation platform to an oceanic operation area;

2) charging ballast tanks of the main body with water; descending the pile legs 6 and the leg sleeves until the leg sleeves land on the seabed; operating the tower crane and the gantry crane and laying out measuring equipment on the support plate of the submergence module; and lifting the main body out of water surface;
3) submerging the submergence module in the water using the lifting devices for underwater operations;
4) hoisting and withdrawing the submergence module in the moonpool using the lifting devices;
5) discharging water in the ballast tanks, withdrawing the pile legs and the leg sleeves in the main body; and
6) navigating the underwater operation platform to a next operation area.

* * * * *